US010086985B2

(12) United States Patent
Klatt

(10) Patent No.: US 10,086,985 B2
(45) Date of Patent: Oct. 2, 2018

(54) SEAL CAP FOR CONTAINER CLOSURE

(71) Applicant: SCHÜTZ GMBH & CO. KGAA, Selters (DE)

(72) Inventor: Bernd Klatt, Ruppach-Goldhausen (DE)

(73) Assignee: SCHÜTZ GMBH & CO. KGAA, Selters (DE)

( * ) Notice: Subject to any disclaimer, the term of this patent is extended or adjusted under 35 U.S.C. 154(b) by 38 days.

(21) Appl. No.: 15/032,458

(22) PCT Filed: Sep. 11, 2014

(86) PCT No.: PCT/DE2014/200468

§ 371 (c)(1),
(2) Date: Apr. 27, 2016

(87) PCT Pub. No.: WO2015/062595

PCT Pub. Date: May 7, 2015

(65) Prior Publication Data

US 2016/0272385 A1 Sep. 22, 2016

(30) Foreign Application Priority Data

Oct. 29, 2013 (DE) ..... 10 2013 221 976

(51) Int. Cl.
*B65D 51/18* (2006.01)
*B65D 41/58* (2006.01)
(Continued)

(52) U.S. Cl.
CPC ..... *B65D 51/18* (2013.01); *B65D 39/025* (2013.01); *B65D 39/082* (2013.01); *B65D 41/58* (2013.01);
(Continued)

(58) Field of Classification Search
CPC .. B65D 51/18; B65D 39/025; B65D 55/0863; B65D 39/082; B65D 41/58;
(Continued)

(56) References Cited

U.S. PATENT DOCUMENTS 4,501,371 A * 2/1985 Smalley ..... B65D 41/48 215/232
2004/0045965 A1* 3/2004 Dwinell ..... B65D 39/08 220/257.2
(Continued)

FOREIGN PATENT DOCUMENTS

CN 1874954 A 12/2006
CN 202295715 U 7/2012
(Continued)

*Primary Examiner* — James N Smalley
(74) *Attorney, Agent, or Firm* — McGlew and Tuttle, P.C.

(57) ABSTRACT

A seal cap (10) for a container closure includes a cover disc (11) having a fastening ring, connected to an underside of the cover disc, with a latching element, for producing a detachable engagement connection with the container closure, connected to a pull tab arranged at the circumference of the cover disc via a connecting element. The connecting element has a cover strip formed in the cover disc that is separated from adjacent areas of the cover disc by lateral cover-strip predetermined breaking lines, which have predetermined breaking elements and has a pull web connected to the latching element of the fastening ring. The cover strip extends from the pull tab, at the circumference of the cover disc into a central inner portion (18) of the cover disc within the fastening ring and the pull web is arranged in an intersecting area between the cover strip and the fastening ring.

20 Claims, 4 Drawing Sheets

(51) Int. Cl.
*B65D 39/08* (2006.01)
*B65D 55/08* (2006.01)
*B65D 39/02* (2006.01)

(52) U.S. Cl.
CPC .. *B65D 55/0863* (2013.01); *B65D 2101/0023* (2013.01); *B65D 2251/0015* (2013.01); *B65D 2251/0075* (2013.01)

(58) Field of Classification Search
CPC .... B65D 2251/0075; B65D 2251/0015; B65D 2101/0023
USPC ..... 220/789, 661; 215/255
See application file for complete search history.

(56) References Cited

U.S. PATENT DOCUMENTS

| | | | | |
|---|---|---|---|---|
| 2005/0092751 | A1* | 5/2005 | Alvares | B65D 21/0219 220/270 |
| 2005/0121451 | A1* | 6/2005 | Van Bruggen | B65D 39/082 220/257.2 |
| 2006/0057257 | A1 | 3/2006 | Ma | |
| 2010/0301046 | A1 | 12/2010 | Schuetz | |
| 2016/0297582 | A1* | 10/2016 | Julien | B65D 39/082 |

FOREIGN PATENT DOCUMENTS

| | | | |
|---|---|---|---|
| EP | 1 514 806 | A2 | 3/2005 |
| EP | 2 144 821 | A1 | 1/2010 |
| FR | 2 635 846 | A1 | 3/1990 |
| GB | 2 222 399 | A | 3/1990 |
| WO | 2008/139196 | A1 | 11/2008 |

* cited by examiner

Fig. 9
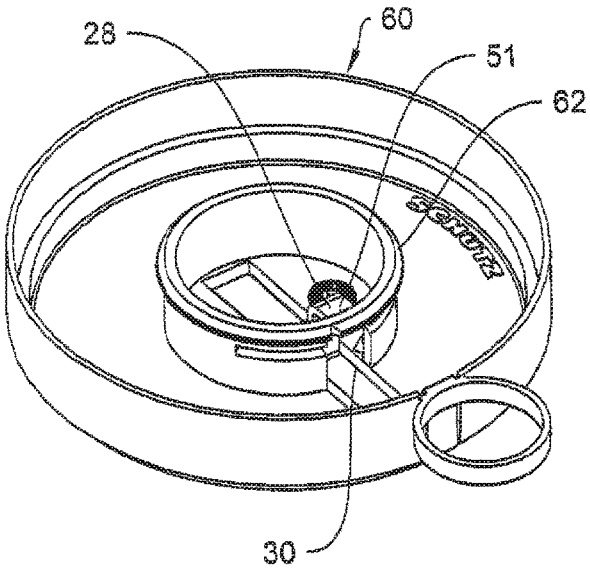
Fig. 10
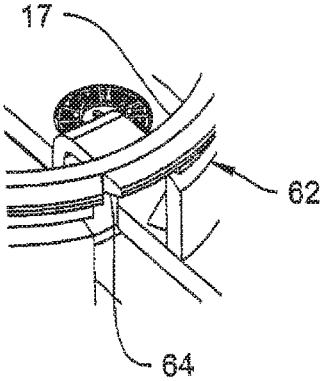
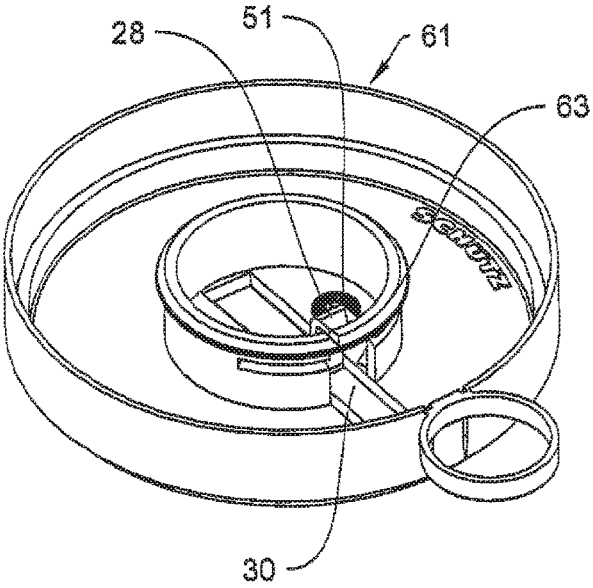
Fig. 11
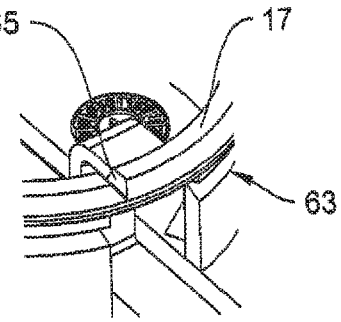
Fig. 12

SEAL CAP FOR CONTAINER CLOSURE

CROSS REFERENCE TO RELATED APPLICATIONS

This application is a United States National Phase Application of International Application PCT/DE2014/200468 filed Sep. 11, 2014 and claims the benefit of priority under 35 U.S.C. § 119 of German Patent Application 10 2013 221 976.8 filed Oct. 29, 2013 the entire contents of which are incorporated herein by reference.

FIELD OF THE INVENTION

The present invention relates to a seal cap for a container closure, comprising a cover disc having a fastening ring connected to an underside of the cover disc, the fastening ring having a latching element for producing a detachable engagement connection with the container closure, the latching element being connected to a pull tab arranged at a circumference of the cover disc via a connecting element, the connecting element having a cover strip formed in the cover disc and separated from adjacent areas of the cover disc by lateral predetermined breaking lines and having a pull web connected to the latching element of the fastening ring.

BACKGROUND OF THE INVENTION

A seal cap of the kind mentioned above is known from EP 2 144 821 A1. The known seal cap is designed in such a manner that the seal cap can be removed from a container closure without the sealing ring, which is provided with the latching element for producing a detachable engagement with the container closure, being detached from the cover disc of the seal cap, the seal cap thus forming a continuous unit even after being removed from the container closure.

To this end, the known seal cap is designed in such a manner that a connecting element remaining intact even after removal of the seal cap from the container closure is provided between the cover disc and the fastening ring. The known seal cap is designed in such a manner that on the one hand, a destroyable connection is provided in the form of a predetermined breaking element between the cover disc and the fastening ring, and on the other hand, a detachable cover strip is formed in the cover disc, said cover strip extending exclusively within a center portion of the cover disc from the cover disc to the fastening ring. Moreover, a predetermined breaking element is provided between an edge apron of the seal cap and the cover disc.

When removing the seal cap from the container closure, both the connection between the cover disc and the fastening ring and a predetermined breaking element between the cover strip and adjacent areas of the cover disc are destroyed. Additionally, the predetermined breaking element between the edge apron of the seal cap and the cover disc is destroyed. After removal of the seal cap from the container closure, a connecting element between a pull tab arranged on the edge apron and the fastening ring remains, said connecting element comprising the edge apron, a pull web remaining between the edge apron and the cover portion and another pull web remaining between an end of the cover strip and the fastening ring.

To remove the seal cap from the container closure, an opening motion is necessary, in which the pull tab formed on the edge apron is gripped at first, the predetermined breaking element between the edge apron and the cover disc is destroyed by a diagonally upward first motion of the edge apron in relation to the cover disc, the first pull web between the edge apron and the cover disc serving as a pivot hinge, and subsequently a pulling force is transmitted from the cover strip via the second pull web onto the fastening ring by a second motion performed in the opposite direction of the first motion so as to inwardly deform the fastening ring and to thus be able to detach the engagement connection between the latching element of the fastening ring and the container closure.

The opening motion composed of two motions in opposite directions is perceived to be very complex in practice, in particular in situations in which relatively limited spatial conditions are present for performing a corresponding opening or removing motion of the seal cap.

SUMMARY OF THE INVENTION

Therefore, an object of the present invention is to design a seal cap in such a manner that the removal of the seal cap from a container closure is simplified.

To attain this object, the seal cap according to the invention is designed in such a manner that the cover strip extends from the pull tab at the circumference of the cover disc into a central inner portion of the cover disc within the fastening ring and the pull web is arranged in an intersecting area between the cover strip and the fastening ring.

The seal cap according to the invention thus allows an opening motion for removing the seal cap from a container closure in which the pull tab is always moved in the same direction. Once the predetermined breaking elements between the cover strip and the cover disc have been destroyed by a diagonally upward motion of the pull tab, a pulling force continues to be exerted on the fastening ring by continuing the motion in the same direction by way of the cover strip and the pull web between the cover strip and the fastening ring owing to the connection between the pull web and the cover strip in an area of intersection between the cover strip and the fastening ring, said pulling force inwardly deforming the fastening ring and allowing the engagement connection between the fastening ring and the container closure to be detached.

In contrast to the known seal cap, the pulling force necessary for removing the seal cap and acting on the fastening ring is transmitted directly from the pull tab to the cover strip and therefrom to the fastening ring via the pull web. In contrast, the pull tab on the known seal cap is not connected directly to the cover strip, but additionally needs the edge apron detachably connected to the cover disc in order to form a force-fitting connection with the cover strip, which means that the removal of the known seal cap from the container closure requires a motion sequence of two motions in opposite directions as described above.

In a preferred embodiment of the seal cap, the pull web between the latching element and the cover strip is connected to the latching element in the area of a recess formed in the fastening ring, making the latching element more easily deformable owing to the recess in the fastening ring.

It is particularly advantageous if adjacent to a connecting area of the pull web, the latching element is separated from a ring base of the fastening ring, said ring base being connected to the cover disc, by latching-element predetermined breaking lines extending parallel to the cover disc and laterally to the pull web, which further increases the deformability of the latching element in relation to the fastening ring, thus facilitating removal of the seal cap from the container closure or a detachment of the engagement between the latching element and the container closure.

If the pull web has a section extending parallel to the cover disc and being connected to the latching element and has a section adjacent thereto extending transversely to the cover disc and being connected to a cover strip section of the cover strip arranged in the inner portion of the cover disc, a largely radial orientation of a pulling force acting on the latching element of the fastening ring becomes possible, a relatively low pulling force thus being sufficient to detach the connection between the latching element and the container closure.

If the cover strip section has a reduced thickness as compared to the cover disc, it is ensured that the stiffness of the cover strip section is reduced as compared to the stiffness of the cover disc, the effect of the pulling force acting onto the latching element from the cover strip thus being increased.

The effect of the pulling force is equally increased and the stiffness of the latching element in the connecting area of the latching element is equally reduced if the latching element has an indentation adjacent to the connecting area of the pull web and in the area of the recess formed in the fastening ring.

It is particularly advantageous if at its circumference, the cover disc has an edge apron arranged concentrically to the fastening ring and separated from the cover disc by a circular edge-apron predetermined breaking line formed along the circumference of the cover disc and if the pull tab of the cover strip is formed in the edge apron in such a manner that the pull tab is connected to adjacent areas of the edge apron at lateral predetermined breaking elements. In this way, it is possible to provide the seal cap with an edge apron covering a potential gap between the cover disc and the container closure without the edge apron interfering with the simple sequence of motions for removing the seal cap from the container closure as described in detail above.

If the fastening ring additionally forms a cup portion of the seal cap together with the central inner portion of the cover disc in such a manner that the inner portion of the cover disc forms a cup bottom formed in the cover disc and the cup bottom is separated from an outer portion of the cover disc by a circular inner-portion predetermined breaking line, a particularly rigid connection is made possible between the cover disc and the fastening ring, which means that a predetermined breaking connection is indirectly provided between the fastening ring and the cover disc via the cup bottom, said predetermined breaking connection making manipulation of the seal cap visible in that the cup bottom is detached from the cover disc together with the fastening ring.

In contrast, the design of the predetermined breaking element known from the state of the art between the cover disc and the fastening ring has the effect that a slight lifting or a slight shifting of the cover disc in relation to the fastening ring including the destruction of the predetermined breaking element is possible without the manipulation attempt being visible on the cover disc.

On the other hand, the stiff connection between the fastening ring and the inner portion of the cover disc provides a connection between the cover disc and the fastening ring that is sufficiently stable to prevent an unintended destruction of the predetermined breaking connection between the fastening ring and the cover disc during mounting of the seal cap.

Preferably, the predetermined breaking elements between the pull tab and the adjacent areas of the edge apron are designed in such a manner in relation to the predetermined breaking element of the edge-apron predetermined breaking line that the predetermined breaking element of the circular edge-apron predetermined breaking line stays intact when the pull tab is detached from the edge apron.

Furthermore, it is advantageous if the predetermined breaking element of the inner-portion predetermined breaking line is designed in such a manner in relation to a predetermined breaking element of a latching-element predetermined breaking line that the predetermined breaking element of the inner-portion predetermined breaking line remains intact when the cover strip is detached from the cover disc.

In the following description, preferred embodiments of the seal cap will be illustrated in more detail with the aid of the drawing. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 9 is a bottom perspective view showing another embodiment of a seal cap;

FIG. 10 is an enlarged detail illustration of the seal cap illustrated in FIG. 9;

FIG. 11 is a bottom perspective view showing another embodiment of a seal cap; and FIG. 12 is an enlarged detail illustration of the seal cap illustrated in FIG. 11.

DESCRIPTION OF THE PREFERRED EMBODIMENTS

Figure 2:
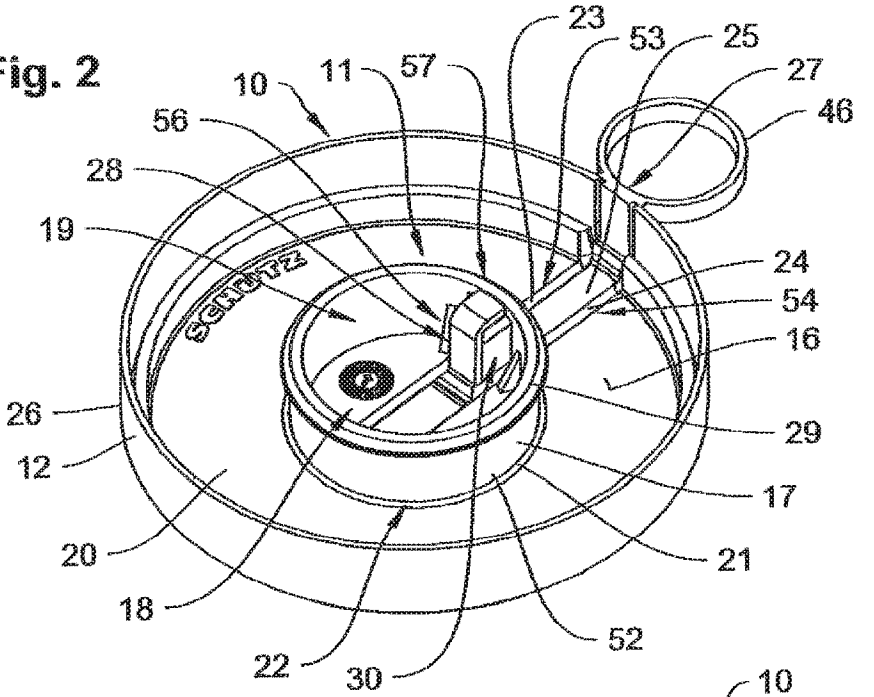
FIG. 2 is a bottom perspective view showing the seal cap illustrated in FIG. 1.
Figure 1:
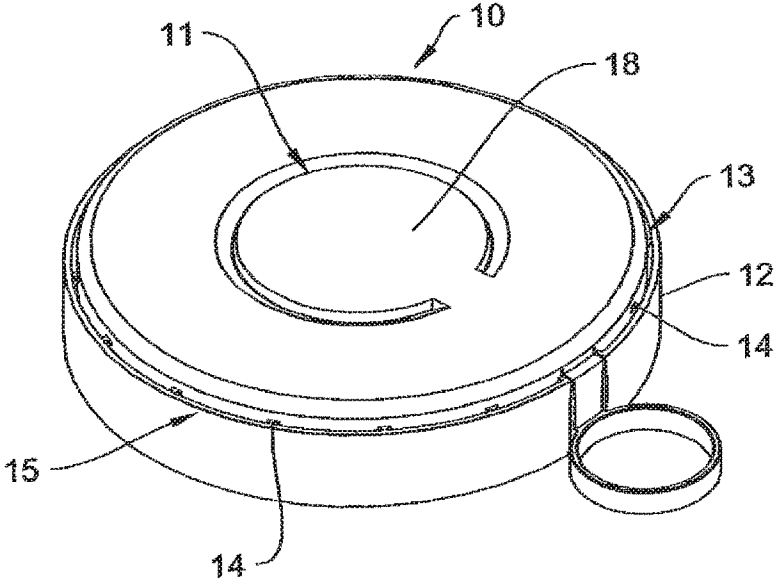
FIG. 1 is a top perspective view showing a seal cap.

In FIGS. 1 and 2, a seal cap 10 is illustrated, which has a cover disc 11 and a sleeve-shaped edge apron 12 extending substantially vertically to the cover disc 11 and being connected to the cover disc 11 along an edge-apron predetermined breaking line 13 via predetermined breaking webs 14, which together form a predetermined breaking element 15.

As can be taken in particular from FIG. 2, a fastening ring 17 is formed on an underside 16 of the cover disc 11, said fastening ring 17 forming a cup portion 19 of the seal cap 10 together with the central inner portion 18 of the cover disc 11 in such a manner that the central inner portion 18 forms a cup bottom of the cup portion 19, said cup bottom being formed integrally in the cover disc. As can further be taken from FIG. 2, the inner portion 18 of the cover disc 11 is separated from an outer portion 20 of the cover disc 11 by a circular inner-portion predetermined breaking line 21, along which a predetermined breaking element 22 is formed, which, in the case at hand, is defined by a groove formed in the underside 16 of the cover disc 11.

Aside from the division into an inner portion 18 and an outer portion 20, the cover disc 11 has a cover strip 25, which is defined by cover-strip predetermined breaking lines 23, 24 having predetermined breaking elements 53, 54 and extending parallel to each other and from a circumference 26 of the cover disc 11 as far as into the inner portion 18 of the cover disc 11. In the case at hand, the predetermined breaking elements 53, 54 are formed by grooves arranged in the underside 16 of the cover disc 11 in conformity with predetermined breaking element 22.

The cover disc 11 has a pull tab 27 arranged at its circumference 26 and connected in a force-fitting manner to a latching element 29 formed at a free axial end of the fastening ring 17 via a connecting element 56, which has the cover strip 25 and a pull web 28 connected to the cover strip 25. The cover strip 25 extends from the pull tab 27 arranged at the circumference 26 as far as into the inner portion 18 of the cover disc 11 within the fastening ring 17, the pull web 28 being arranged in an intersecting area 57 between the cover strip 25 and the fastening ring 17.

Figure 3:
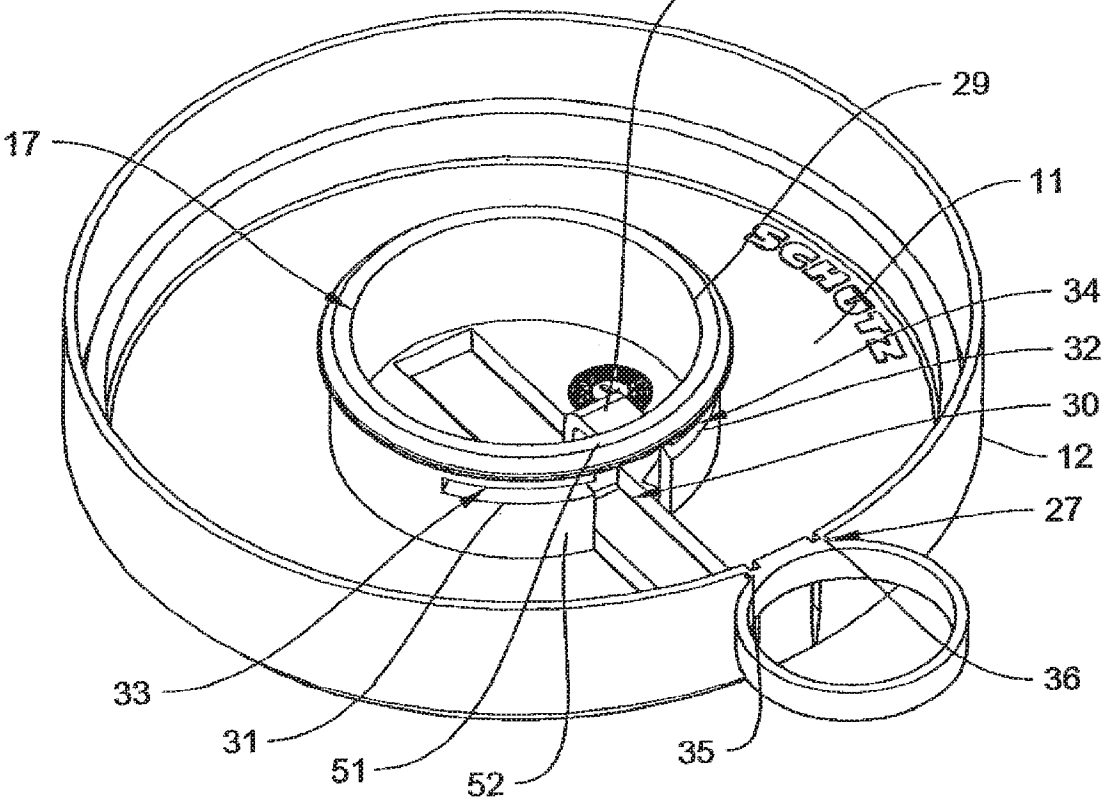
FIG. 3 is a bottom perspective view showing another illustration of the seal cap illustrated in FIG. 1.

As shown in FIGS. 2 and 3, the pull web 28 extends in the area of a recess 30 formed in a ring base 52 of the fastening ring 17, said ring base 52 being connected to the cover disc 11 and said recess extending from the latching element 29 to the cover disc 11, the latching element 29 here being annular. Adjacent to a connecting area 51 between the pull web 28 and the latching element 29, latching-element predetermined breaking lines 31, 32 are formed in the fastening ring 17, which extend parallel to the cover disc 11 and separate the latching element 29 from the ring base 52 and, in the case at hand, have grooves introduced into the fastening ring, which serve as predetermined breaking elements 33, 34.

As becomes clear from a combined view of FIGS. 1, 2 and 3, the pull tab 27 formed at the end of the cover strip 11 is formed in the edge apron 12, predetermined breaking elements formed by predetermined breaking webs 35, 36 at the lower edge of the edge apron 12 in the case at hand being provided between the pull tab 27 and adjacent areas of the edge apron.

Figure 4:
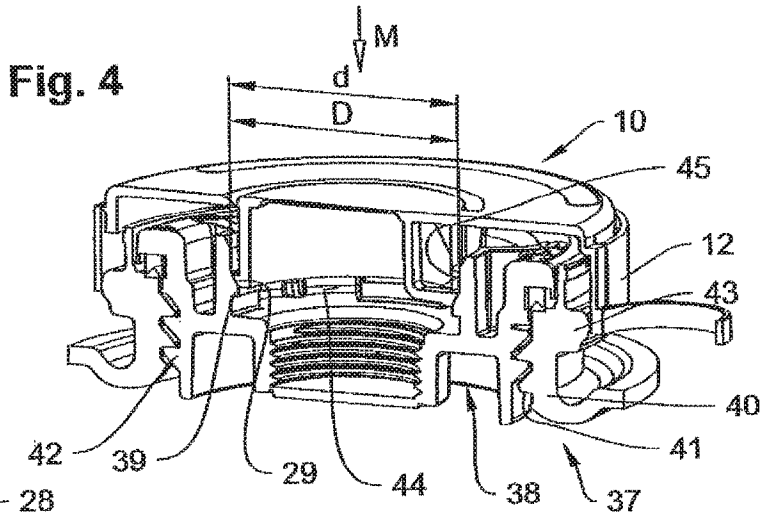
FIG. 4 is a sectional illustration of the seal cap during mounting prior to the production of an engagement connection between the seal cap and a container closure.

FIG. 4 shows the seal cap 10 arranged on a container closure 37 during mounting immediately prior to the production of a latching engagement of the latching element 29 with a latching web 39 formed on a container plug 38 of the container closure 37.

The container closure 37 is formed on a plastic container (not illustrated) and has a closure neck 40 having an inner thread 41 for receiving the container plug 38 screwed into the closure neck 40 with its outer thread 42.

As shown in FIG. 4, to produce a latching engagement of the seal cap 10 with the container closure 37, the seal cap 10 is first arranged on the container closure 37 in such a manner that the latching element 29 formed on the fastening ring 17 axially supports itself on the latching web 39 of the container plug 38. In this arrangement of the seal cap 10 relative to the container closure 37, as shown in FIG. 4, the edge apron 12 arranged on the cover disc 11 is arranged at the circumference of an annular protrusion 43 formed on the closure neck 40.

The fastening ring 17 has an outer diameter d that substantially corresponds to an inner diameter D of a mounting opening 44 of the container plug 38 so that an inner wall 45 of the mounting opening 44 acts as a radial guide for the fastening ring 17 until the latter abuts against the latching web 39 when the seal cap 10 is arranged on the container closure 37. Based on the position of the seal cap 10 relative to the container closure 37 as illustrated in FIG. 4, by which a coaxial arrangement of the seal cap 10 relative to the container closure 37 or to the container plug 38 is defined, the fastening ring 17 can now be radially deformed by applying a defined axial mounting force M, the latching element 29 of the fastening ring 17 being subsequently latched behind the latching web 39 as illustrated in FIG. 5, thus completing the mounting of the seal cap 10 on the container closure 37.

Figure 5:
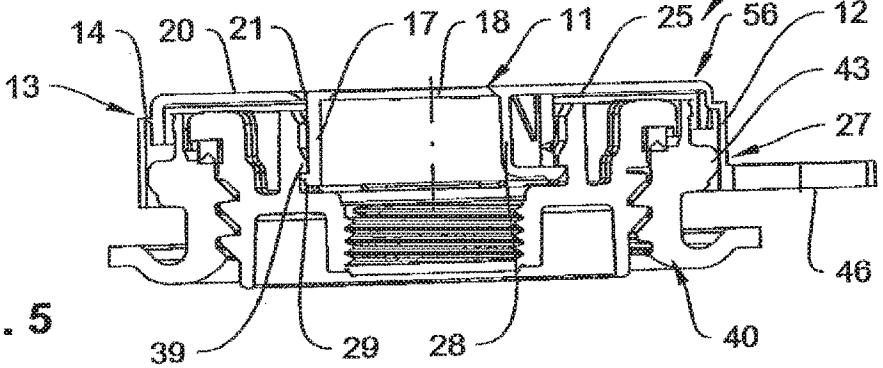
FIG. 5 is a sectional illustration of the seal cap illustrated in FIG. 3 after completed mounting in an engagement connection with the container closure.

As can now be taken from FIG. 5, in the illustrated sealing position of the seal cap 10, the edge apron 12 protrudes beyond the annular protrusion 43 of the closure neck 40 so that direct access to the cover disc 11 of the seal cap for removing the seal cap 10 from the container closure 37 is impossible. Instead, access to the cover disc 11 from the periphery of the seal cap 10 is possible only via the edge apron 12, which is connected to the seal cap 11 via the predetermined breaking webs 14 along the edge-apron predetermined breaking line 13. An attempt to remove the cover disc 11 from the container closure 37 by applying a force to the edge apron 12 will thus necessarily lead to destruction of the predetermined breaking webs 14, making manipulations of this kind easily visible on the seal cap 10.

Even an attempt to remove the seal cap 10 by direct access from above will be visible because of the above-described division of the cover disc 11 into an outer portion 20 and an inner portion 18 by an inner-portion predetermined breaking line 21 because the predetermined breaking element 22 formed along the inner-portion predetermined breaking line 21 is destroyed in this case.

To open or demount the seal cap 10 in a regular way, the above-described pull tab 27 is used, which is connected to the latching element 29 of the fastening ring 17 via the connecting element 56 formed by the cover strip 25 and the pull web 28.

Figure 8:
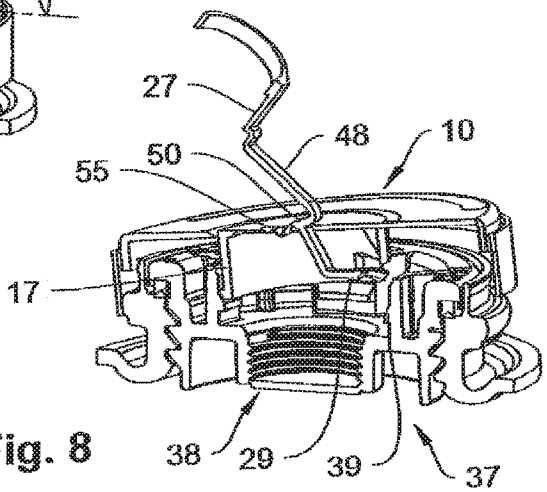
FIG. 8 is a sectional illustration showing the seal cap arranged on the container closure in another of successive phases of demounting.
Figure 7:
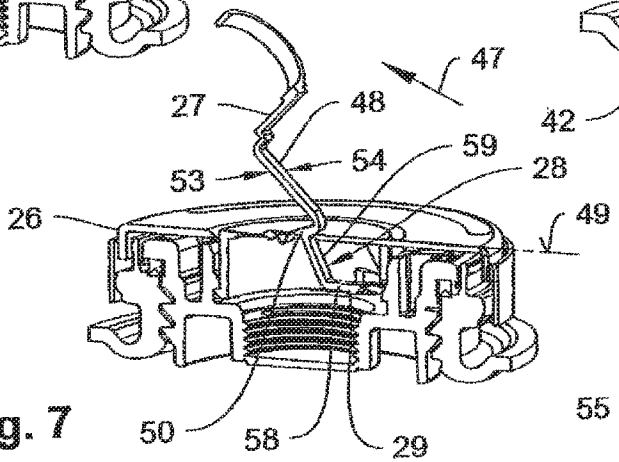
FIG. 7 is a sectional illustration showing the seal cap arranged on the container closure in another of successive phases of demounting.
Figure 6:
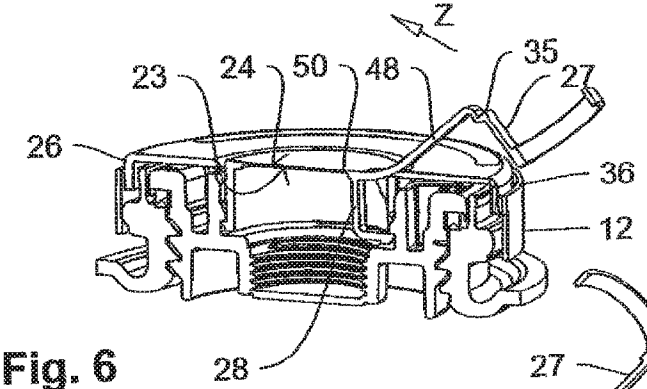
FIG. 6 is a sectional illustration showing the seal cap arranged on the container closure in one of successive phases of demounting.

As shown in FIG. 5, a handle element 46, formed as an annular lug in this case, is provided at the end of the pull tab 27, said handle element 46 being gripped and moved in a substantially linear diagonally upward opening motion 47 as illustrated in FIGS. 6 to 8 in order to remove the seal cap 10.

As shown in FIG. 6, the effect of a pulling force Z acting on the pull tab 27 will first destroy the predetermined breaking elements 35 and 36 (FIG. 3) formed by predetermined breaking webs between the free end of the pull tab 27 and the edge apron 12. Subsequently, if the pulling force keeps acting on the pull tab 27, the predetermined breaking elements 53, 54 along the cover-strip predetermined breaking lines 23, 24 will be destroyed and a radially outer first cover strip section 48 extending from the circumference 26 of the cover disc 12 to the pull web 28 formed on the underside of the cover strip 25 will swing upward out of a cover disc plane 49.

If the opening motion 47 continues, a connecting area 50, in which the cover strip 25 is connected to the pull web 28, will initially act as a pivot hinge until the cover strip section 48 and the pull tab 28, which extends from the latching element 29 toward the cover strip 25, are oriented in about the same direction, resulting in a radially inward deformation of the latching element 29 and in a detachment of a second cover strip section 55 from the cover disc due to the pulling force acting on the latching element 29, the second cover strip section 55, however, remaining connected at its end to the inner portion of the cover disc 11. The radial deformation of the latching element is supported by the fact that a section 58 of the pull web 28 adjacent to the latching element 29 extends parallel to the cover disc. A section 59 extending transversely to the cover disc 11 is provided for connecting section 58 to the cover strip 25.

Moreover, the effect of the pulling force Z for achieving the strong radial deformation of the latching element 29 is increased by deforming or compressing a radially inner cover strip section 55, which has a reduced thickness, and by the weakening of a deformation cross-section of the fastening ring 17 due to the recess 30 formed in the fastening ring 17 in the connecting area 51 of the pull web 28.

As shown in FIG. 8, when the opening motion 47 continues, the engagement connection between the latching element 29 of the fastening ring 17 and the latching web 39 of the container plug 38 is completely detached, allowing the seal cap 10 to be removed from the container closure 37.

In FIGS. 9 to 12, seal caps 60, 61 are illustrated that have a latching element 62 (FIGS. 9 and 10) and a latching element 63 (FIGS. 11 and 12), respectively, while being otherwise identical to seal cap 10.

Latching element 62 has a radially outer indentation 64 adjacent to the connecting area 51 of the pull web 28 and in the area of the recess 30 formed in the fastening ring 17. Latching element 63 has an axial indentation 65 adjacent to the connecting area 51 of the pull web 28 and in the area of the recess 30 formed in the fastening ring 17.

Because of the indentation 64 or 65, the radial deformation of the latching element 29 explained above with reference to FIGS. 6 to 8 can lead to a ripping or severing of the latching element 29 in the area of the indentation 64 or 65, which means that the pulling force Z needed to detach the engagement of the latching element 29 with the latching web 39 can be reduced.

While specific embodiments of the invention have been shown and described in detail to illustrate the application of the principles of the invention, it will be understood that the invention may be embodied otherwise without departing from such principles.

The invention claimed is:

1. A seal cap for a container closure, the seal cap comprising a cover disc;

a fastening ring connected to an underside of the cover disc, the fastening ring having a latching element for producing a detachable engagement connection with the container closure;

a connecting element; and a pull tab arranged at a circumference of the cover disc and connected to the latching element via the connecting element, the connecting element having a cover strip formed in the cover disc and being separated from adjacent areas of the cover disc by lateral cover-strip predetermined breaking lines, which have predetermined breaking elements, and having a pull web connected to the latching element of the fastening ring, wherein the cover strip extends from the pull tab, at the circumference of the cover disc, into a central inner portion of the cover disc within the fastening ring and the pull web is arranged in an intersecting area between the cover strip and the fastening ring.

2. The seal cap according to claim 1, wherein the pull web between the latching element and the cover strip is connected to the latching element in the area of a recess formed in the fastening ring.

3. The seal cap according to claim 1, wherein adjacent to a connecting area of the pull web, the latching element is separated from a ring base of the fastening ring, which is connected to the cover disc, by latching-element predetermined breaking lines extending parallel to the cover disc and laterally to the pull web.

4. The seal cap according to claim 1, wherein the pull web has a section extending parallel to the cover disc and being connected to the latching element and has a section adjoining thereto and extending transversely to the cover disc and being connected to a cover strip section of the cover strip, the cover strip section being arranged in the inner portion of the cover disc.

5. The seal cap according to claim 4, wherein the cover strip section has a thickness that is reduced as compared to the cover disc.

6. The seal cap according to claim 1, wherein the latching element has an indentation adjacent to the connecting area of the pull web and in the area of the recess formed in the fastening ring.

7. The seal cap according to claim 1, wherein at a circumference of the cover disc the cover disc has an edge apron arranged concentrically to the fastening ring and separated from the cover disc by a circular edge-apron predetermined breaking line formed along the circumference of the cover disc and the pull tab of the cover strip is formed in the edge apron such that the pull tab is connected to adjacent areas of the edge apron at lateral predetermined breaking elements.

8. The seal cap according to claim 1, wherein the fastening ring forms a cup portion of the seal cap together with the central inner portion of the cover disc in such a manner that the inner portion of the cover disc forms a cup bottom formed in the cover disc and the cup bottom is separated from an outer portion of the cover disc by a circular inner-portion predetermined breaking line.

9. The seal cap according to claim 1, wherein predetermined breaking elements between the pull tab and the adjacent areas of the edge apron are configured in relation to the predetermined breaking element of the edge-apron predetermined breaking line such that the predetermined breaking elements of the edge-apron predetermined breaking line remain intact when the pull tab is detached from the edge apron.

10. The seal cap according to claim 1, wherein the predetermined breaking element of the inner-portion predetermined breaking line is configured in relation to a predetermined breaking element of a latching-element predetermined breaking line such that the inner-portion predetermined breaking line remains intact when the cover strip is detached from the cover disc.

11. A seal cap for a container closure, the seal cap comprising:

a cover disc comprising an outer edge and a longitudinal axis, the outer edge defining a circumference of the cover disc;

a fastening ring connected to an underside of the cover disc, the fastening ring having a latching element for producing a detachable engagement connection with the container closure;

a connecting element comprising a cover strip and lateral cover-strip predetermined breaking lines, the lateral cover-strip predetermined breaking lines comprising predetermined breaking elements, the cover strip being separated from adjacent areas of the cover disc by the lateral cover-strip predetermined breaking lines; and a pull tab arranged at the circumference of the cover disc, the pull tab being connected to the latching element via the connecting element, the connecting element having a pull web connected to the latching element of the fastening ring, wherein the cover strip extends in a radial direction, with respect to the longitudinal axis, from the pull tab to a position in a central inner portion of the cover disc within the fastening ring and the pull web is arranged in an intersecting area between the cover strip and the fastening ring.

12. The seal cap according to claim 11, wherein the lateral cover-strip predetermined breaking lines extend from the outer edge to at least the fastening ring.

13. The seal cap according to claim 11, wherein the fastening ring comprises a fastening ring outer surface, the lateral cover-strip predetermined breaking lines extending from the outer edge to at least the fastening ring outer surface.

14. The seal cap according to claim 11, wherein the lateral cover-strip predetermined breaking lines extend from the outer edge to the position in the central inner portion of the cover disc.

15. The seal cap according to claim 11, wherein adjacent to a connecting area of the pull web, the latching element is separated from a ring base of the fastening ring, which is connected to the cover disc, by latching-element predetermined breaking lines extending parallel to the cover disc and laterally to the pull web.

16. A seal cap for a container closure, the seal cap comprising:

a cover disc comprising an outer wall and a longitudinal axis, the outer wall extending in a circumferential direction with respect to the longitudinal axis;

a fastening ring connected to an underside of the cover disc, the fastening ring being located radially inward of the outer wall with respect to the longitudinal axis, the fastening ring having a latching element for producing a detachable engagement connection with the container closure;

a connecting element comprising a cover strip and lateral cover-strip predetermined breaking lines, the lateral cover-strip predetermined breaking lines comprising predetermined breaking elements, the cover strip being separated from adjacent areas of the cover disc by the lateral cover-strip predetermined breaking lines; and a pull tab arranged at the circumference of the cover disc, the pull tab being connected to the latching element via the connecting element, the connecting element having a pull web connected to the latching element of the fastening ring, the pull web being located adjacent to the fastening ring, wherein the cover strip extends in a radial direction, with respect to the longitudinal axis, from the pull tab to a position in a central inner portion of the cover disc within the fastening ring and the pull web is arranged in an intersecting area between the cover strip and the fastening ring.

17. The seal cap according to claim 16, wherein the pull web is located radially inward of the outer wall with respect to the longitudinal axis.

18. The seal cap according to claim 17, wherein the fastening ring comprises a fastening ring wall defining an interior space of the fastening ring, the pull web being located in the interior space.

19. The seal cap according to claim 16, wherein the lateral cover-strip predetermined breaking lines extend from the outer edge to the position in the central inner portion of the cover disc.

20. The seal cap according to claim 16, wherein adjacent to a connecting area of the pull web, the latching element is separated from a ring base of the fastening ring, which is connected to the cover disc, by latching-element predetermined breaking lines extending parallel to the cover disc and laterally to the pull web.

* * * * *